US006390211B1

(12) United States Patent
Tibbitts

(10) Patent No.: US 6,390,211 B1
(45) Date of Patent: May 21, 2002

(54) VARIABLE ORIENTATION NOZZLES FOR EARTH BORING DRILL BITS, DRILL BITS SO EQUIPPED, AND METHODS OF ORIENTING

(75) Inventor: Gordon A. Tibbitts, Salt Lake City, UT (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/337,610

(22) Filed: Jun. 21, 1999

(51) Int. Cl.[7] ..... E21B 10/60
(52) U.S. Cl. ..... 175/340; 175/393; 175/424
(58) Field of Search ..... 175/340, 393, 175/424; 239/587.1, 587.2, 587.3, 587.4, 587.5

(56) References Cited

U.S. PATENT DOCUMENTS

| | | | | | |
|---|---|---|---|---|---|
| 1,388,490 | A | | 8/1921 | Suman | 175/391 |
| 1,799,473 | A | | 4/1931 | Martin | 175/393 |
| 2,055,145 | A | | 9/1936 | Christian | 175/393 |
| 2,119,349 | A | | 5/1938 | Pearce | 255/61 |
| 2,122,063 | A | | 6/1938 | Hughes | 255/71 |
| 2,218,130 | A | | 10/1940 | Court | 15/104.12 |
| 2,545,195 | A | | 3/1951 | Crake | 255/61 |
| 3,059,708 | A | | 10/1962 | Cannon et al. | 175/393 |
| 3,137,354 | A | | 6/1964 | Crawford et al. | 175/340 |
| 3,153,458 | A | | 10/1964 | Short | 175/393 |
| 3,180,440 | A | | 4/1965 | Bridwell | |
| 3,563,324 | A | | 2/1971 | Lauber | 175/393 |
| 3,823,789 | A | | 7/1974 | Garner | 175/340 |
| 3,881,561 | A | | 5/1975 | Pols et al. | 175/393 |
| 3,897,836 | A | * | 8/1975 | Hall et al. | 175/93 |
| 3,924,698 | A | | 12/1975 | Juvkam-Wold | 175/393 |
| 4,031,971 | A | | 6/1977 | Miller | 175/107 |
| 4,106,577 | A | | 8/1978 | Summers | 175/340 |
| 4,221,336 | A | * | 9/1980 | Diamond | 239/428.5 |
| 4,341,273 | A | | 7/1982 | Walker et al. | 175/393 |
| 4,533,005 | A | | 8/1985 | Morris | 175/393 |
| 4,624,330 | A | | 11/1986 | Zijsling | 175/393 |
| 4,668,018 | A | | 5/1987 | Demoulin et al. | |
| 4,687,066 | A | | 8/1987 | Evans | 175/340 |
| 4,711,311 | A | | 12/1987 | Underwood et al. | 175/340 |
| 4,723,612 | A | | 2/1988 | Hicks | 175/393 |
| 4,739,845 | A | | 4/1988 | Dennis | 175/393 |
| 4,776,412 | A | | 10/1988 | Thompson | 175/393 |
| 4,787,465 | A | | 11/1988 | Dickinson, III et al. | 175/67 |
| 4,794,995 | A | | 1/1989 | Matson et al. | 175/393 |
| 4,850,440 | A | * | 7/1989 | Smet | 176/67 |
| 5,099,935 | A | | 3/1992 | Anthon et al. | 175/426 |
| 5,139,202 | A | * | 8/1992 | Munoz et al. | 239/587.4 |
| 5,178,222 | A | | 1/1993 | Jones et al. | 175/398 |
| 5,199,516 | A | * | 4/1993 | Fernandez | 175/366 |
| 5,220,966 | A | | 6/1993 | Awdujewski et al. | 175/339 |
| 5,230,389 | A | | 7/1993 | Besson | 175/56 |
| 5,285,859 | A | | 2/1994 | Tibbitts | 175/57 |
| 5,378,048 | A | * | 1/1995 | Parrott | 299/81 |
| 5,967,244 | A | | 10/1999 | Arfele | 175/340 |
| 6,029,756 | A | | 2/2000 | Britzke et al. | 175/57 |

FOREIGN PATENT DOCUMENTS

| | | |
|---|---|---|
| WO | WO 98/59147 | 12/1998 |

* cited by examiner

*Primary Examiner*—William Neuder
(74) *Attorney, Agent, or Firm*—TraskBritt

(57) ABSTRACT

Drill bit nozzle assemblies and methods of mounting the nozzle assemblies relative to a drill bit for drilling subterranean earth formations are described in which the nozzle assembly provides diverse rotational orientation of the nozzle about at least two axes relative to the drill bit. The nozzle assemblies generally include a nozzle body and an associated, cooperatively-configured nozzle body housing structure to facilitate orientation of the nozzle body within a nozzle orifice of a drill bit body and securement of the nozzle assembly with the nozzle body in a desired orientation.

22 Claims, 9 Drawing Sheets

VARIABLE ORIENTATION NOZZLES FOR EARTH BORING DRILL BITS, DRILL BITS SO EQUIPPED, AND METHODS OF ORIENTING

BACKGROUND OF THE INVENTION

1. Field of the Invention

The present invention relates to nozzles for use in subterranean earth boring drill bits and drill bits so equipped and, more particularly, to nozzles capable of various angles of adjustment to direct drilling fluid to different locations on and around the drilling apparatus.

2. State of the Art

Subterranean drilling operations generally employ a rotary type drill bit that is rotated while being advanced through rock formations. Elements on the face of the drill bit cut the rock while drilling fluid removes formation debris and carries it back to the surface. The drilling fluid is pumped from the surface through the drill stem and out through one or more, and usually a plurality of, nozzles located on the drill bit. The nozzles direct jets of the fluid to clean and cool cutting surfaces of the drill bit and for the aforementioned debris removal.

Because of the importance of the cooling and cleaning functions of the drilling fluid, others in the field have attempted to optimize these benefits by specifically orienting the nozzle exit to direct the drilling fluid to a predetermined location on a cutting surface of the bit. For example, U.S. Pat. No. 4,776,412 describes a nozzle assembly designed to resist rotational forces while directing drilling fluid to a predetermined rotational position. The nozzle's internal chamber is preformed to direct the fluid at a specific angle. Likewise, in U.S. Pat. No. 4,794,995, a nozzle is disclosed that changes the direction of fluid flow by angling the exit of the nozzle chamber. Again, the angle of exit is predetermined and may only be rotated about its longitudinal axis. U.S. Pat. No. 4,533,005 is another example of an attempt to provide a nozzle that may be reoriented to provide fluid flow in a specific direction. However, similar to other attempts, once the nozzle has been manufactured, the nozzle angle with respect to the longitudinal axis of the nozzle may not be changed.

The limited ability to adjust state of the art nozzles of a drill bit to accommodate desired fluid directions necessarily limits the amount of positioning or adjustment that can be attained to accurately establish a desired angle of fluid flow, and therefore limits the potential efficiency of the cleaning and cooling functions of the drilling fluid. The ease of manufacture of such nozzles is also limited because for every desired angle, the prior art systems require manufacture of another nozzle. Thus, it would be advantageous to provide a nozzle for use in subterranean earth boring drill bits which provides variable orientability of the nozzle relative to, but independent of, the orientation of the nozzle assembly in the drill bit. It would also be advantageous to provide a nozzle design that does not require a separately manufactured nozzle for every desired angle of drilling fluid flow.

BRIEF SUMMARY OF THE INVENTION

In accordance with the present invention, a nozzle and a system for mounting the nozzle provide modifiable orientation of the nozzle relative to a drill bit to enable accurate and efficient cleaning and cooling of the bit and its cutting structure by drilling fluid passing through the nozzle during subterranean earth boring operations.

According to the invention, a nozzle is structured to be adjustably orientable relative to a surface on a drill bit. The nozzle is thereafter secured into a nozzle orifice on the drill bit. That is, the nozzle orientation may be adjusted relative to the drill bit surface until a desired angle of fluid flow is achieved, then the nozzle is secured into the nozzle orifice of the drill bit. The nozzle is structured to permit a plurality of orientations with respect to the drill bit surface.

The nozzle comprises a nozzle body and a housing that secures the nozzle body within the nozzle orifice and provides the orientability feature of the present invention. The nozzle body may be spherical or tapered on its outer surface and includes a fluid passageway formed within. The nozzle may be formed of any suitable material with adequate abrasion and erosion resistance, such as tungsten carbide, or ceramics. Alternatively, the nozzle passage may be lined with such a material. The adjustable nozzle may be preferably removably secured within the nozzle orifice by suitable mechanical means known in the art including threaded sleeves or retainers or permanently secured therein by brazing, adhesive bonding, or welding. Thermally activated adhesives or metal bonding agents may be especially suitable for use, as easily activated by a torch.

In one preferred embodiment, the nozzle body is secured to a threaded sleeve at a predetermined angle during the manufacturing process. The may be secured by adhesive bonding, welding, brazing, or other means known in the art. The nozzle's threaded sleeve may then be inserted into the nozzle orifice with the nozzle positioned toward the cutting surface at the desired angle. A distinct advantage of this configuration is the ease in manufacturing a single nozzle body, rather than complex configurations requiring manufacture of various exit angles within the nozzle body.

In another preferred embodiment, the fluid passage of the nozzle is formed into a spherically shaped nozzle body. The spherically shaped nozzle body is then secured into the nozzle orifice by a number of threaded and/or non-threaded sleeves. These sleeves secure the nozzle body into the nozzle orifice at a desired angle. Thus, a single nozzle assembly may be used at several locations on the drill bit, each oriented to better clean and cool the drilling apparatus.

Finally, in another preferred embodiment, the nozzle body's external periphery is tapered toward the exit port of the nozzle body. The nozzle body is then secured in the nozzle orifice by sleeves that orient the nozzle body and thus the direction of fluid flow. That is, the surface of the sleeve that is in contact with the nozzle body provides the desired angle. This embodiment eliminates the costly manufacture of variously angled nozzle passages within the nozzle body. This, and other advantages of the present invention, will become apparent from the following detailed description, the accompanying drawings, and the appended claims.

Methods of orienting and securing nozzle assemblies according to the present invention are also contemplated as included within the invention as well as tools for effecting such orientation and securement.

DETAILED DESCRIPTION OF THE PREFERRED EMBODIMENTS

Figure 1:
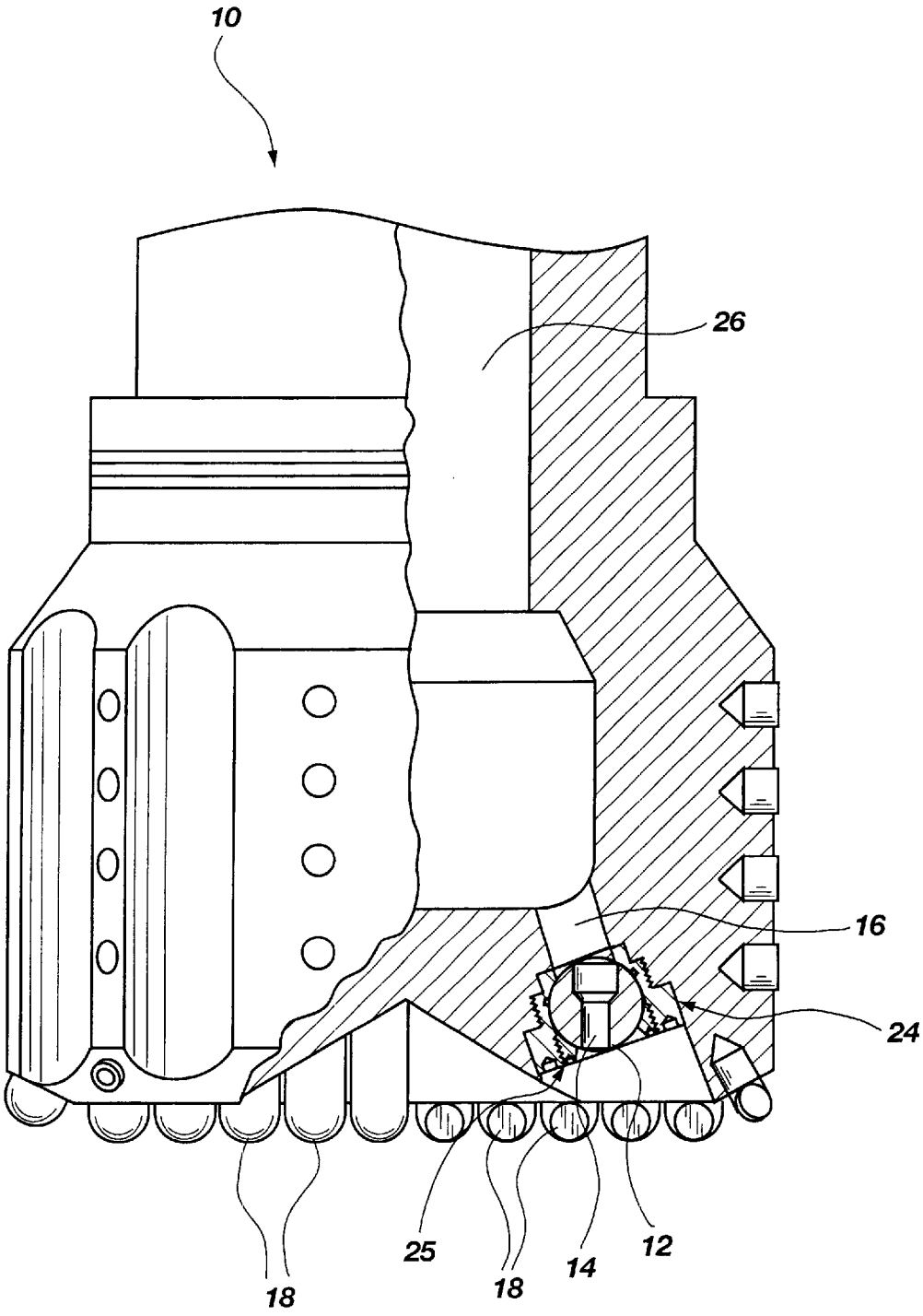
FIG. 1 is a side elevation of a drag type drill bit, partially sectioned to expose a nozzle according to the present invention.
Figure 10:
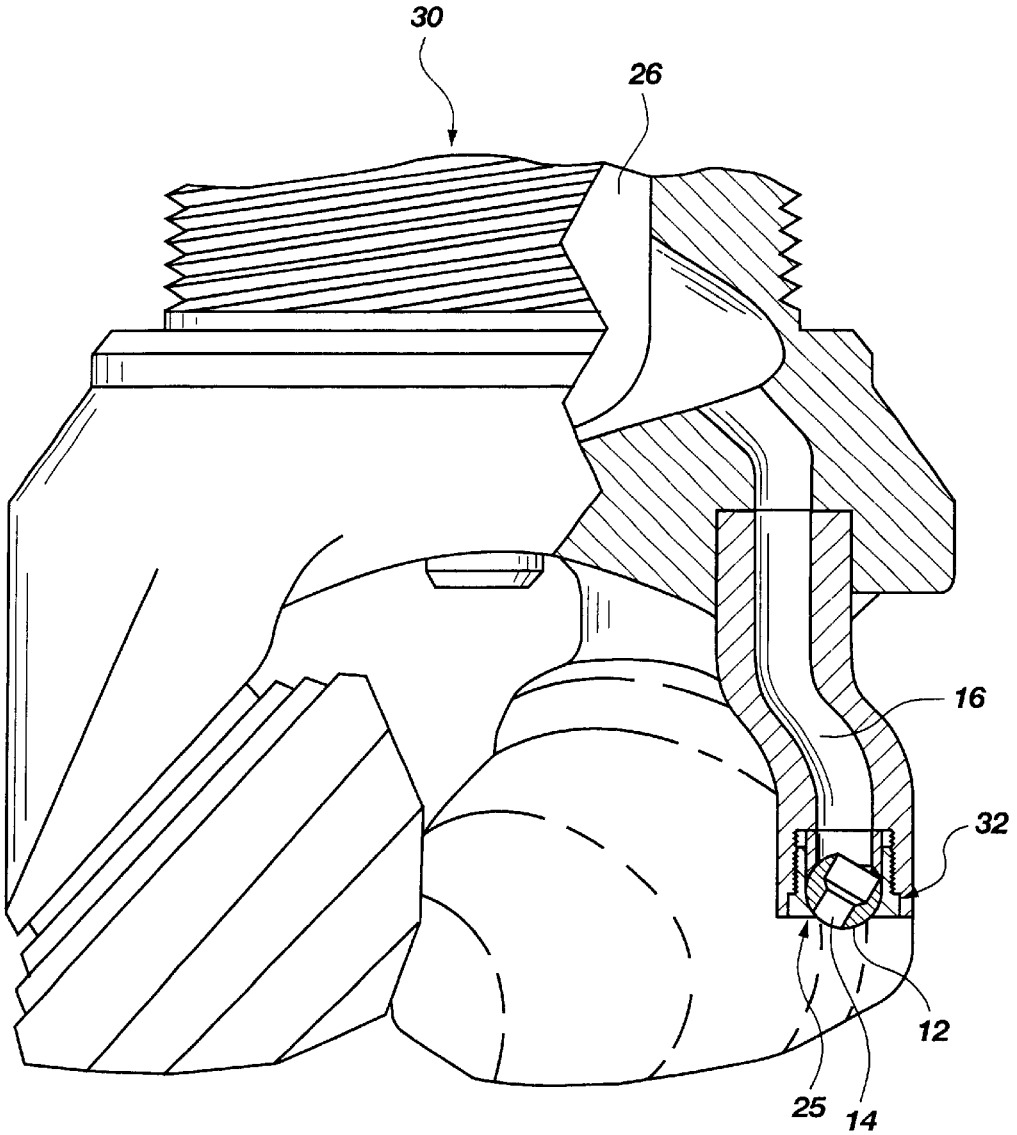
FIG. 10 is a side elevation of a tri-cone drill bit, partially sectioned to expose a nozzle according to the present invention.

The invention is illustrated in the drawings with reference to a typical rotary earth boring bit. Referring to FIG. 1, an exemplary drag-type rotary bit 10 is shown, although the present invention possesses equal utility in the context of a tri-cone or "rock" bit 30 (see FIG. 10). A plurality of cutting elements 18 is secured to the face of the drill bit for cutting rock as the drill bit is rotated into a subterranean formation. A plurality of nozzles 25 (only one shown for purposes of illustration) according to the present invention is mounted in the face of the drill bit for directing drilling fluid to a desired location at the bottom of the borehole being cut. The drilling fluid is conducted to nozzles 25 through a passage or plenum 26 in the drill bit that communicates with a nozzle orifice 16. The nozzles 25 are threadedly secured at the outer end of the orifices 16 and include nozzle exits or fluid passages 14 through which the drilling fluid is discharged. The drilling fluid cleans and cools the cutting elements 18 and carries formation cuttings to the top of the borehole via the annular space between the drill string and the borehole wall. It will be understood by those of ordinary skill in the art that a bladed-type bit carrying cutting elements 18 on one or more blades extending below the bit face may also be configured to incorporate the nozzles of the present invention and that the present invention exhibits equal utility with all configurations of drag bits, while demonstrating particular utility with bits wherein precise and diverse orientation of fluid flow is beneficial to the hydraulic performance of the bit.

Figure 2:
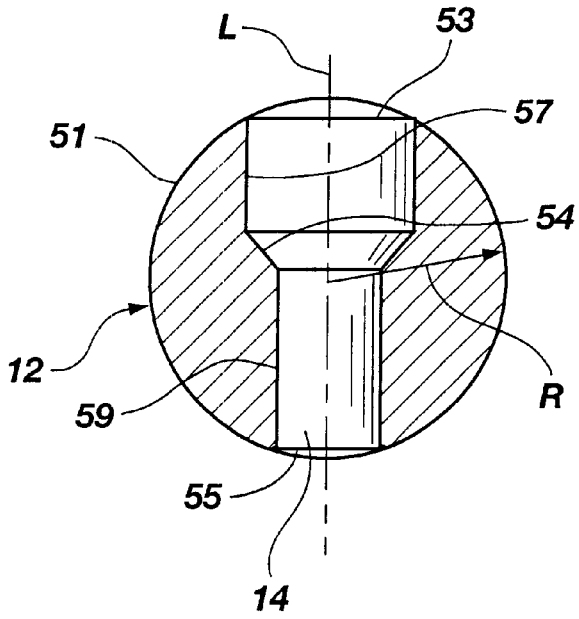
FIG. 2 is a sectional view taken through the longitudinal center of a nozzle body with a symmetrical fluid passage.
Figure 2A:
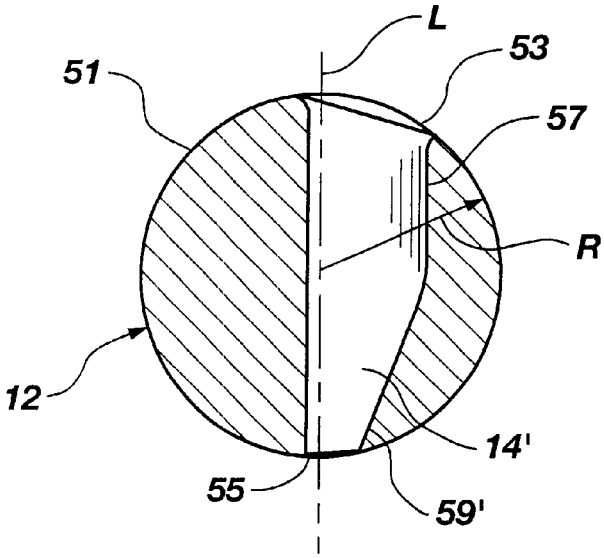
FIG. 2A is a sectional view of a nozzle body similar to that of FIG. 2, but with an asymmetrical fluid passage.
Figure 3:
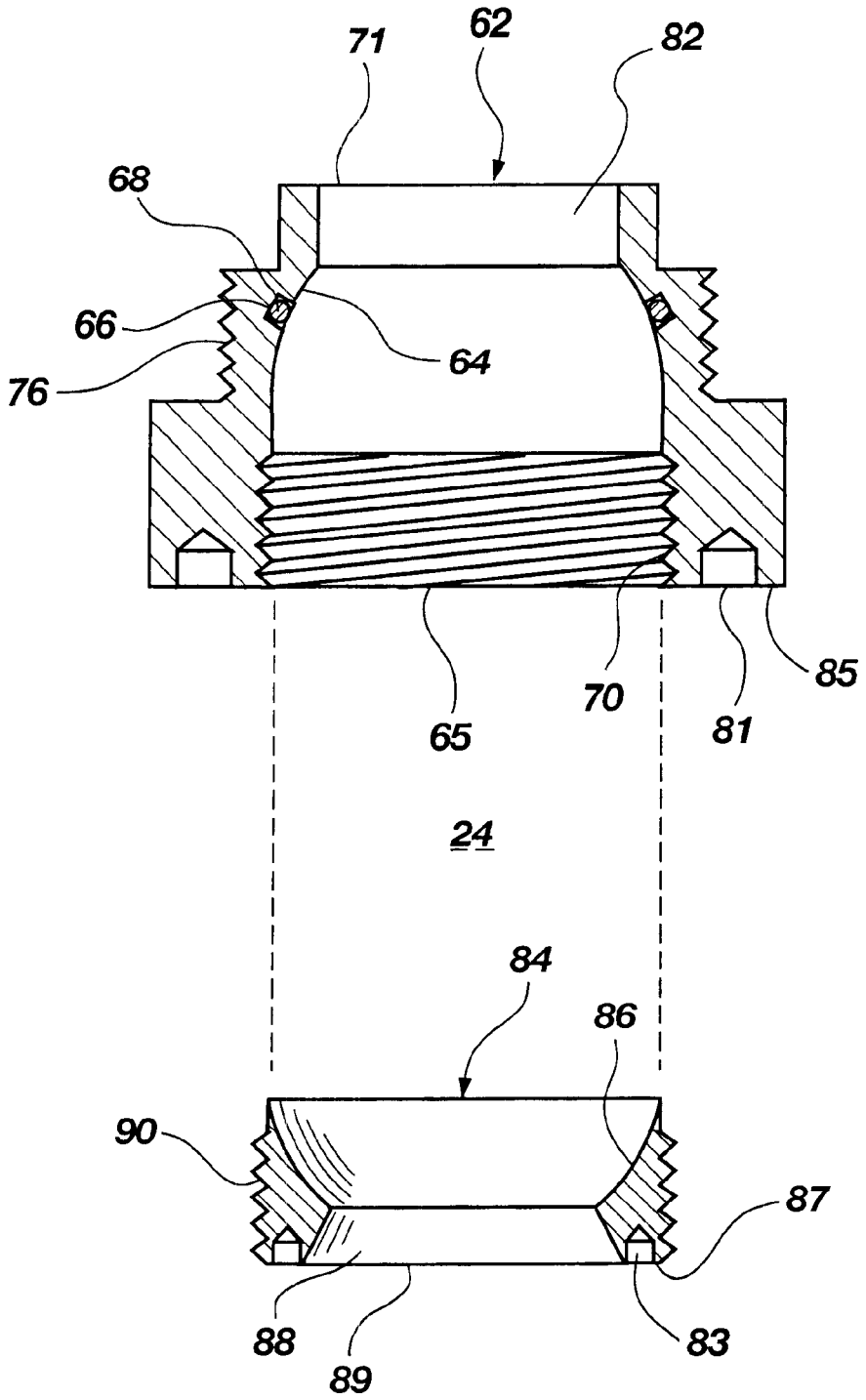
FIG. 3 is a sectional view taken through the longitudinal center of a pair of sleeves that forms an alternate nozzle body housing.
Figure 7:
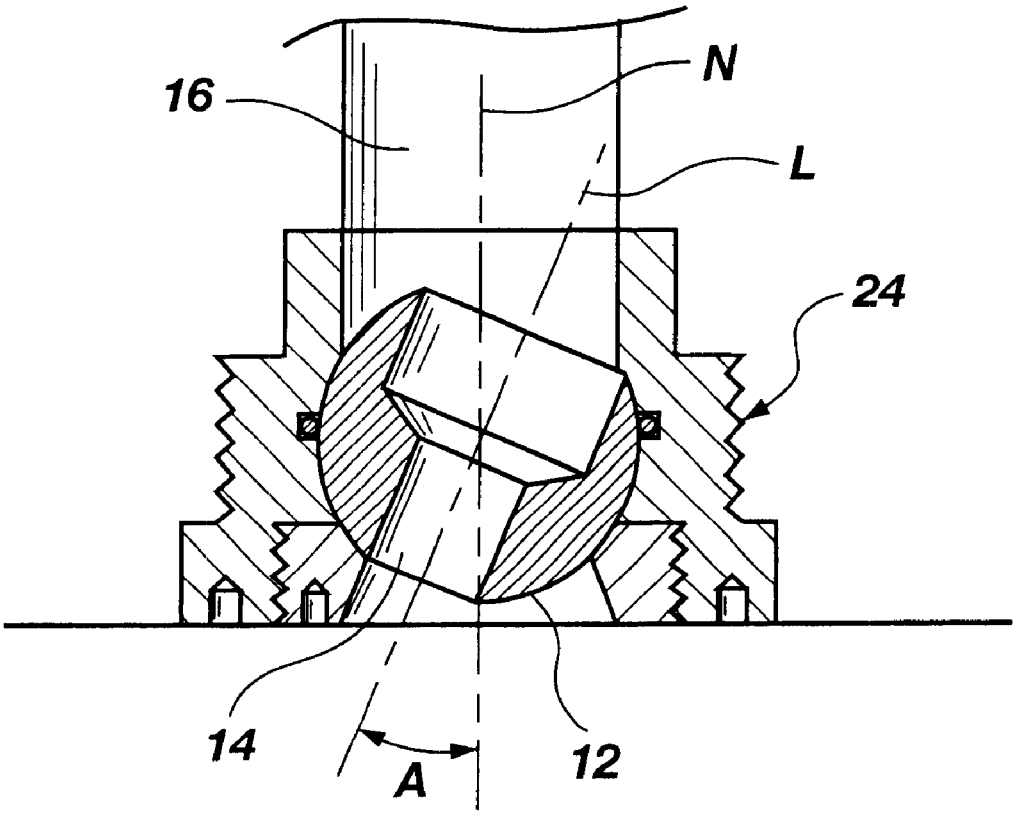
FIG. 7 is a sectional view taken through one of the nozzle assemblies of the preferred embodiments depicting the angle of orientation.

Referring now to FIGS. 2, 2A and 3, each of nozzles 25 (as shown in FIG. 1) may comprise a nozzle body 12 having a substantially spherical outer surface 51 of a radius R and a housing 24 (as shown in FIG. 1) for securing the nozzle body 12 into nozzle orifice 16. The fluid passage 14 in the nozzle body 12 of FIG. 2 is of the type which is symmetrical relative to a longitudinal axis L of the nozzle body 12, whereby the passage 14 can be oriented by rotating the nozzle body 12 about any axis. That is, the passage 14 may direct a stream of fluid through the nozzle body 12 in a direction coaxial with the longitudinal axis L which is at a desired angle A relative to the longitudinal axis N of the nozzle orifice (see FIG. 7). The longitudinal axis L of the nozzle may be changed with respect to the longitudinal axis N of the nozzle orifice 16 by rotating the nozzle body 12 about a horizontal axis and may be rotationally oriented with respect to longitudinal axis N of nozzle orifice 16 as desired.

An outlet portion 55 of the nozzle body has a circular passage 59 of smaller inner diameter than a circular passage 57 of an inlet portion 53 of the nozzle body 12. A beveled or frustoconical transition surface 54 interconnects the two passages 57, 59, the transition surface 54 being oriented concentrically relative to the longitudinal axis L. The nozzle body 12 is preferably formed of tungsten carbide, so as to be resistant to the abrasive and erosive effects of drilling fluid during a drilling operation. Alternatively, passage 14 of nozzle body 12 may be formed of, for example, steel be to lined with an abrasion and erosion-resistant material such as tungsten carbide, ceramics or polyurethanes.

FIG. 2A depicts an alternative interior arrangement for nozzle body 12, wherein a fluid passage 14' is asymmetrically located in nozzle body 12 laterally offset from longitudinal axis L. In this embodiment, circular passage 57 necks down to outlet portion 55 via tapered passage 59', which may be asymmetric as shown or comprise a symmetrical, frustoconical passage. Of course, fluid passage 14' may be of asymmetric cross section throughout its entire extent, or be of symmetric cross section other than circular, such as rectangular, octagonal, etc.

The housing 24, which comprises threaded sleeves 62, 84, encases the outer peripheral surface of the nozzle body 12 so as to allow the nozzle body 12 to be rotatable relative thereto. An outer cylindrical surface of support sleeve 62 is formed with screw threads 76 which are adapted to be threadedly received by internal threads cast or machined in the nozzle orifice 16 of the drill bit. An annular channel 66 in the inner periphery of sleeve 62 is adapted to receive an O-ring seal 68. The inner periphery of support sleeve 62 also has screw threads on its lower end 65 to receive threaded retention sleeve 84.

Inner surface 64 of support sleeve 62 and inner surface 86 of retention sleeve 84 are shaped complementarily to the outer surface 51 of the nozzle body 12. That is, the sleeves'respective inner surfaces 64 and 86 have radii to match the outer radius R of nozzle body 12. The radii of the sleeves' inner surfaces are closely matched and slightly larger than those of the outer surface of the nozzle body so that the nozzle body 12 is freely rotatable on the inner surfaces 64, 86 of the sleeves 62, 84 but with relatively little play. The curved surfaces 64, 86 constitute abutment surfaces of the nozzle which enable the sleeves to displace the nozzle body 12 into the orifice 16 when the assembled housing 24 with nozzle body 12 in place is screwed into the nozzle orifice 16.

Support sleeve 62 includes a fluid passage 82 at its upper end 71 of substantially the same diameter as the nozzle orifice 16 immediately adjacent its outer end where nozzle 25 is secured. At its lower end 65, support sleeve 62 comprises an inner peripheral surface 70 that is threaded to match the threads 90 on retention sleeve 84. Retention sleeve 84 includes a fluid exit passage 88 at its lower end 89 that allows unrestricted fluid flow for various orientations of nozzle body 12.

The front end surface 87 of the retention sleeve 84 contains a plurality of bore holes 83 (e.g., six) adapted to receive complementarily shaped protrusions 200 on a tool such as a wrench 190 (FIG. 9) to enable an operator to secure the sleeve 62 and thus the nozzle 25 into the nozzle orifice 16 by means of the wrench 190. Likewise, the front end surface 85 of the sleeve 62 contains a plurality of bore holes 81 (e.g., six) adapted to receive complementarily shaped protrusions of a wrench similar to that depicted in FIG. 9. The sleeves may be formed of a softer material (e.g., steel) than the nozzle body to facilitate the cutting of screw threads therein, or of other suitable materials such as ceramics, which may be formed by casting.

Figure 8:
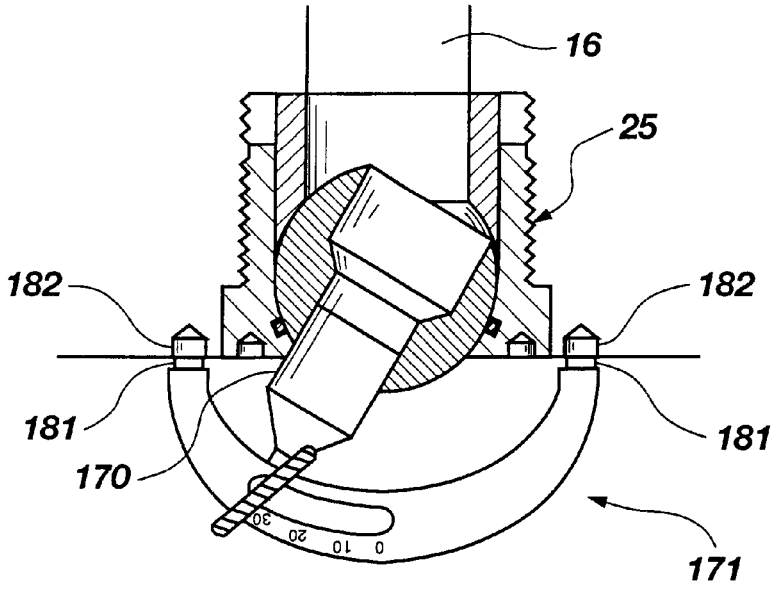
FIG. 8 is a sectional view taken through one of the nozzle assemblies of the preferred embodiments depicting a tool used to hold the nozzle in the desired position during installation.
Figure 9:
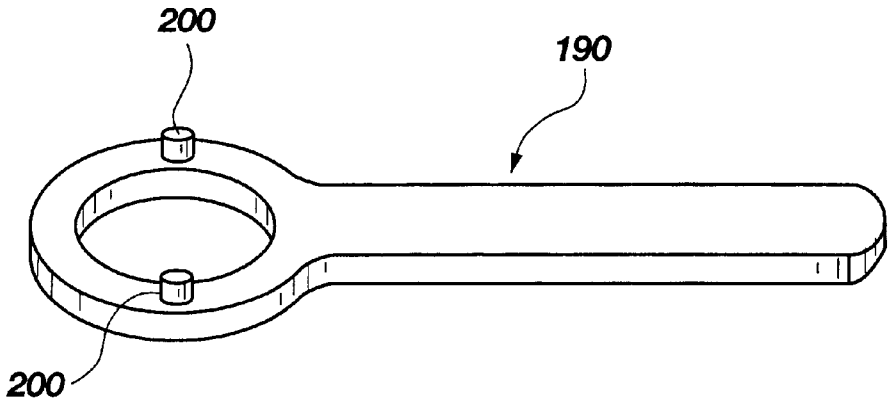
FIG. 9 is a perspective view of a tool used to rotate and tighten a threaded nozzle assembly.

To install the nozzle 25, the support sleeve 62 is tightly screwed into the nozzle orifice 16 of the drill bit 10 using a wrench 190 of the type shown in FIG. 9. The nozzle body 12 is then inserted into support sleeve 62 with outlet portion 55 of nozzle body 12 facing the lower end 65 of support sleeve 62 and held in place by screwing retention sleeve 84 into support sleeve 62. The protrusions 200 of wrench 190 are inserted into bore holes 83 of sleeve 84 while orientation tool 171 is used to retain the desired angle, as shown in FIG. 8. By inserting rod 170 into fluid passage 14 and inserting protrusions 181 into holes 182 in the bit face surrounding nozzle orifice 16, orientation tool 171 will keep nozzle body 12 in position while wrench 190 is rotated to tighten threaded sleeve 84.

Figure 4:
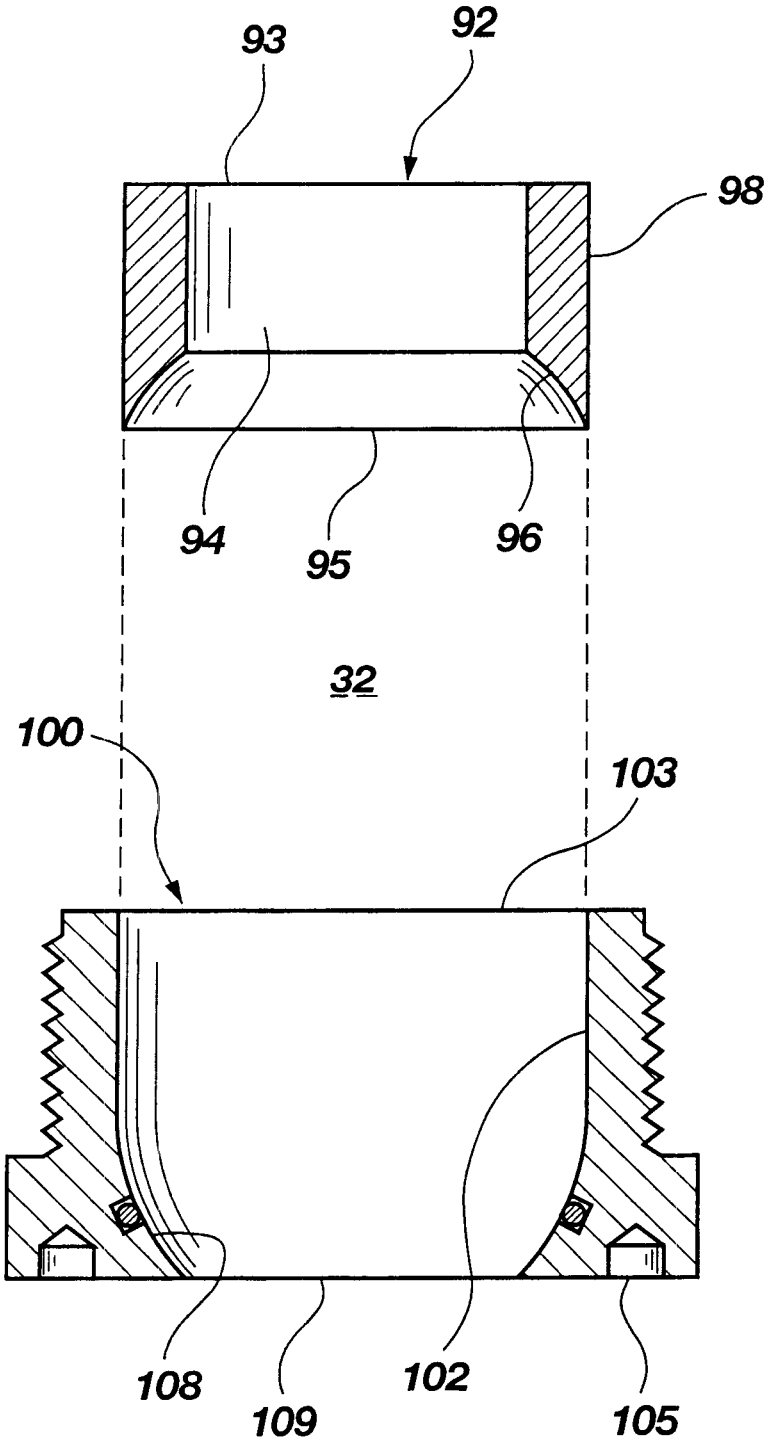
FIG. 4 is a sectional view taken through the longitudinal center of a pair of sleeves that forms an alternate nozzle body housing.

Referring now to FIGS. 2, 2A and 4, another preferred embodiment is shown similar to the embodiment depicted in FIGS. 2, 2A and 3. Housing 32 is similar to housing 24 in that it is comprised of two sleeves 92, 100 which encase nozzle body 12 so that the nozzle body 12 may be rotatable relative thereto. Housing 32 differs from housing 24 in that the upper end 103 of the inner periphery 102 of sleeve 100 is of slightly larger diameter outer periphery 98 than sleeve 92 to secure sleeve 92 therein. Sleeve 92 slidably fits within the upper end of sleeve 100 to secure nozzle body 12. Inner surfaces 96, 108 of the sleeves 92–100 are shaped complementarity to the outer surface 51 of the nozzle body 12. Further, sleeve 92 comprises a fluid passage 94 at its upper end 93 that matches the diameter of the nozzle orifice 16 adjacent its outer end.

This nozzle assembly is installed in a similar manner to the previously-described embodiment. The nozzle body 12 is inserted into the upper end 103 of the sleeve 100 with front portion 55 of nozzle body 12 facing the front end 109 of sleeve 100. The lower end 95 of sleeve 92 is then inserted into the upper end 103 of sleeve 100. The sleeves 92, 100 and the nozzle body 12 are then inserted into the nozzle orifice 16 to be screwed into place by use of wrench 190. The protrusions 200 of wrench 190 are inserted into holes 105 of sleeve 100 while orientation tool 171 is used to retain the desired angle as shown in FIG. 8. Rod 170 is inserted into fluid passage 14 and protrusions 181 are inserted into holes 182. Orientation tool 171 is used to keep nozzle body 12 in position while wrench 190 is rotated to tighten threaded sleeve 100.

In yet another preferred embodiment (FIG. 5), the nozzle body 151 is similar to nozzle body 12 depicted in FIG. 3 except that the outer surface 158 has been tapered towards the nozzle exit. As with nozzle body 12, the fluid passage 14 is defined by segments 57, 54 and 59. The housing 134 is comprised of outer sleeve 140 and two inner sleeves 142, 150. The outer sleeve 140 comprises an outer periphery 138 that is threaded to be threadedly attached to nozzle orifice 16. The inner periphery 139 of sleeve 140 is cylindrical and complementarily sized to receive the inner sleeves 142, 150. Sleeve 140 has holes 148 (e.g. six) formed in its lower surface 147 to receive protrusions 200 of wrench 190. The sleeves 140, 142, 150 fit together so that the outer sleeve 140 may be freely rotated with respect to the inner sleeves 142, 150, with relatively little play.

The inner sleeve 142 has an internal passage 153 to allow drilling fluid to reach nozzle body 151. The lower surface 159 of sleeve 142 is angled about the longitudinal axis N to match the angle of the top surface 156 of nozzle body 151 when the latter is placed inside sleeve 150. The lower surface 159 of the sleeve 142 also provides an orienting abutment for nozzle body 151.

Sleeve 150 has an upper internal periphery 154 sized and shaped to complementarily match the outer surface 158 of nozzle body 151 and to provide an orienting abutment thereto. The upper internal periphery 154 of sleeve 150 is angled about the longitudinal axis N of the nozzle orifice 16 to orient the nozzle body about longitudinal axis L. The lower internal periphery 164 of sleeve 150 provides an exit passage 165 for fluid flow exiting nozzle body 151.

To install nozzle body 151 into nozzle orifice 16, sleeve 150 is slidably inserted into sleeve 140. Nozzle body 151 is then placed inside upper internal periphery 154 of sleeve 150. Sleeve 142 is then slidably inserted into sleeve 140 and placed on top of nozzle body 151 to form an abutment for the nozzle body 151. The entire nozzle assembly 135 is then threadedly engaged into nozzle orifice 16. As described in other embodiments, wrench 190 is used to tighten sleeve 140 into nozzle orifice 16 while the direction of the nozzle in the radial plane transverse to longitudinal axis L can be maintained by insertion of a rod in the nozzle passage. Orientation tool 171 is not required. It is apparent that, by use of differently-angled, selected complementary sleeve configurations, a single nozzle body 151 may be oriented at a plurality of preselected angles in nozzle orifice 16 with respect to axis N.

Figure 5:
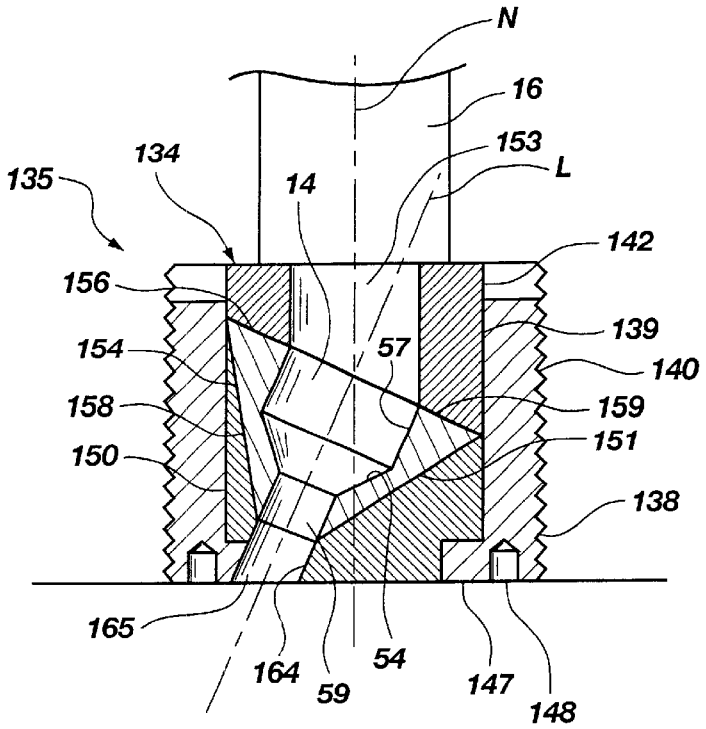
FIG. 5 is a sectional view taken through one of the nozzle assemblies of the preferred embodiments of the present invention.
Figure 11:
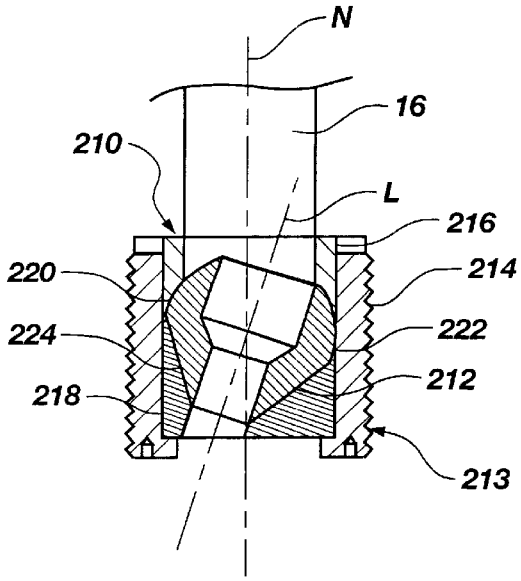
FIG. 11 is a sectional view taken through one of the nozzle assemblies of the preferred embodiments of the present invention.

The embodiment depicted in FIG. 11 is similar to that shown in FIG. 5 with slight variations. The nozzle assembly 210 is comprised of a nozzle body 212 and a nozzle housing 213 that includes an outer sleeve 214 and two inner sleeves 216, 218. Outer periphery 220 of nozzle body 212, rather than being tapered along the entire longitudinal length L of the outer surface 158 as shown with regard to nozzle body 151 in FIG. 5, has an upper hemisphere 222 similar to nozzle body 12 (see FIG. 2). The lower portion 224, though, is tapered similar to the nozzle body 151 depicted in FIG. 5.

In this embodiment, the shape of the upper inner sleeve 216 does not need to be altered with a corresponding change in the configuration of the lower inner sleeve 218. Thus, to adjust the angle of fluid flow from the nozzle orifice 16, only the lower sleeve 218 needs to be changed. Installation of the nozzle assembly 210 is accomplished in the same manner as that required for the nozzle assembly shown in FIG. 5.

Figure 6:
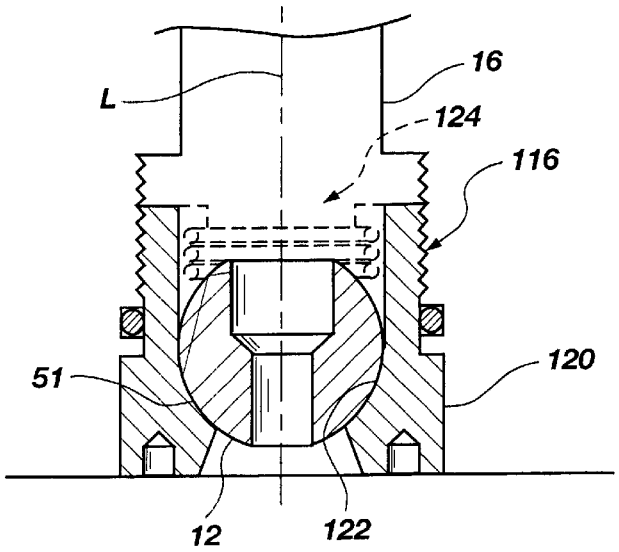
FIG. 6 is a sectional view taken through one of the nozzle assemblies of the preferred embodiments of the present invention.

Still another preferred embodiment is shown in FIG. 6. This nozzle assembly 116 is similar to other embodiments except that it is comprised of a single housing sleeve 120 and nozzle body 12. In this configuration, nozzle body 12 is attached to housing sleeve 120 by brazing, welding, adhesive bonding or other means known in the prior art. Nozzle body 12 may be oriented at a desired angle relative to longitudinal axis L before or after installation in the drill bit and then permanently attached to housing sleeve 120 thereafter. The installation of nozzle assembly 116 may be achieved using wrench 190. In lieu of attachment of nozzle body 12 to housing sleeve 120, it may be adhesively bonded with a weak adhesive and held in place by differential pressure of the drilling fluid. The mating surfaces 51 and 122 of the nozzle body 12 and sleeve 120 may be roughened to enhance their mutual engagement and position retention. As a further alternative, nozzle body 12 may be spring-loaded against housing sleeve 120 as shown in broken lines 124 in FIG. 6. While a coil-type spring element 124 is shown, it will also be appreciated that a pre-loaded (compressed) elastomeric member may also be employed as a biasing element. A preferred nozzle passage orientation can thus be readily achieved, and maintained by fluid pressure during the drilling operation.

Figure 12A:
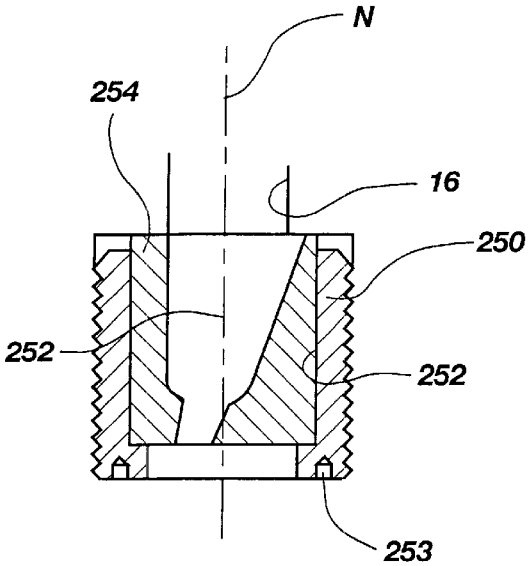
FIGS. 12A and 12B are sectional views of further preferred embodiments of the present invention.
Figure 12B:
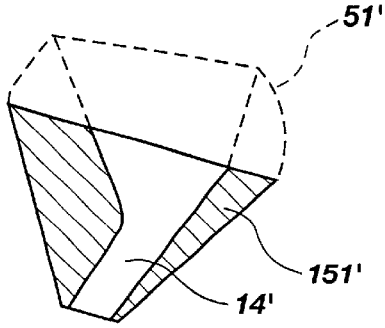

FIGS. 12A and 12B depict further embodiments of the present invention. The embodiment of FIG. 12A comprises an even more simplified version of the embodiments of FIGS. 5 and 11, wherein an exteriorly-threaded outer housing sleeve 250 having an inner bore 252 with annular stop 253 at the lower end thereof receives a nozzle body 254 of a slightly smaller outer diameter than that of inner bore 252 and having a fixed-angle fluid passage 256 therethrough oriented at an acute angle to longitudinal axis N of nozzle orifice 16. Nozzle body 254 is freely rotatable about the longitudinal axis N of nozzle orifice 16 to a selected position until outer housing sleeve 250 is firmly made up in threaded nozzle orifice 16. Thus, a number of interchangeable nozzle bodies 254 having different, preselected angles may be substituted within outer housing sleeve 250. The embodiment of FIG. 12B merely comprises a nozzle body 151' being identical on its exterior to nozzle body 151 but having a different interior configuration, nozzle body 151' being substitutable in the embodiment of FIG. 5 for nozzle body 151. As shown in FIG. 12B, nozzle body 151' defines an asymmetrical interior fluid passage 14' rather than a symmetrical passage as with nozzle body 151. Such a configuration may permit a more severe angular departure from the longitudinal axis N of nozzle orifice 16 than the symmetrical fluid passage arrangement of nozzle body 151. The asymmetrical fluid passage may also be employed with the embodiment of FIG. 11 by configuring the upper (inlet) portion of nozzle body 151' substantially as a truncated hemisphere, as shown in broken lines 51'.

The present invention enables a variably orientable nozzle to be easily and effectively installed in place in proper orientation. The invention also includes tools for holding the position of the nozzle body and tightening the retaining sleeves to secure the nozzle at the desired orientation.

While certain representative embodiments and details have been shown for purposes of illustrating the invention, it will be apparent to those skilled in the art that various changes in the methods and apparatus disclosed herein may be made without departing form the scope of the invention, which is defined in the appended claims. For example, multiple nozzle passages may be included in each nozzle; other nozzle body and passage cross-sectional shapes may be employed; and various alternative structures may be used to attach the nozzle body to the bit which allow for nozzle exit angle adjustment.

What is claimed is:

1. A nozzle assembly for use on a drill bit for subterranean drilling, comprising:

a nozzle element including at least one passage therethrough for directing a flow of drilling fluid from a fluid outlet on a face of said drill bit, said nozzle element including a substantially frustoconical exterior surface; and an attachment structure for axially and rotationally securing said nozzle element with respect to said fluid outlet and with said at least one passage in communication therewith, wherein said attachment structure includes a first inner sleeve member configured to cooperatively receive at least a portion of the substantially frustoconical exterior surface of the nozzle element, a second inner sleeve member cooperative with said nozzle element, and an outer sleeve member wherein the nozzle element and the first and second inner sleeve members are each at least partially disposed within the outer sleeve member, and wherein the attachment structure is cooperatively configured with said nozzle element to permit substantial variable orientation thereof.

2. The nozzle assembly of claim 1, wherein said nozzle element variable orientation includes at least two degrees of freedom.

3. The nozzle assembly of claim 1, further comprising a positioning member for holding said nozzle element in a selected orientation during securement of said nozzle element to said fluid outlet.

4. The nozzle assembly of claim 1, wherein said fluid outlet has threads associated therewith, and further including threads for securing said attachment structure within said fluid outlet by engagement with said associated threads.

5. The nozzle assembly of claim 1, wherein said at least one passage is symmetric in configuration.

6. The nozzle assembly of claim 1, wherein said at least one passage is asymmetric in configuration.

7. The nozzle assembly of claim 1, wherein said at least one passage is asymmetrically located within said nozzle element.

8. The nozzle assembly of claim 1, wherein said nozzle element is disposed between said first and second inner sleeve members and wherein said first and second inner sleeve members are configured to cooperatively define an orientation of said nozzle element relative to the outer sleeve member.

9. A nozzle assembly for use on a drill bit for subterranean drilling, comprising:

a nozzle body including a substantially frustoconical exterior configuration;

a nozzle body housing structure for axially and rotationally securing said nozzle body to said drill bit in selectively, substantially variable rotational orientation with respect to said nozzle body housing structure; and a sleeve member removably positioned within the nozzle body housing, the sleeve member being configured to cooperatively receive at least a portion of the substantially frustoconical exterior configuration of the nozzle body.

10. The nozzle assembly of claim 9, where said nozzle body defines at least one passage extending therethrough.

11. The nozzle assembly of claim 9, wherein said nozzle body exhibits at least two degrees of freedom with respect to said nozzle body housing structure.

12. The nozzle assembly of claim 9, wherein said nozzle body includes at least one passage therethrough lined with an abrasion and erosion-resistant material selected from the group consisting of carbides, ceramics and polyurethanes.

13. The nozzle assembly of claim 9, wherein said nozzle body housing structure comprises an internal periphery at least partially complementarily matched to an exterior configuration of said sleeve member.

14. The nozzle assembly of claim 13, wherein said nozzle body housing structure internal periphery comprises an abutment for said sleeve member.

15. The nozzle assembly of claim 13, wherein said sleeve member is configured to orient said nozzle body at a predetermined angle with respect to a longitudinal axis of said nozzle assembly upon receipt of the nozzle body thereby.

16. The nozzle assembly of claim 9, wherein said nozzle body housing structure is formed of a material selected from the group consisting of steel, carbides and ceramics.

17. A drill bit for subterranean drilling operations comprising:

a drill bit body having an outer surface orientable toward an earthen formation to be drilled;

at least one cutting structure carried by said drill bit body;

at least one drilling fluid outlet associated with said drill bit body; and at least one nozzle assembly securable with respect to said at least one drilling fluid outlet, said at least one nozzle assembly being configured to permit substantial rotational adjustment of a portion thereof for selective orientation of a fluid passage therethrough, in communication with said at least one drilling fluid outlet, said at least one nozzle assembly including a nozzle body housing, a sleeve member removably disposed within said nozzle body housing, said sleeve member including an internal periphery portion at least partially cooperatively configured to receive and axially and rotationally secure a nozzle body having a substantially frustoconical exterior surface.

18. The drill bit of claim 17, wherein said at least one nozzle assembly includes a nozzle body including a substantially frustoconical exterior surface.

19. The drill bit of claim 18, wherein said sleeve member is configured to orient said nozzle body at a predetermined angle with respect to a longitudinal axis of said nozzle assembly upon receipt of the nozzle body thereby.

20. The drill bit of claim 18, wherein said nozzle body housing includes structure securing said at least one nozzle assembly to said drill bit.

21. The drill bit of claim 18, wherein said fluid passage is of symmetric configuration.

22. The drill bit of claim 18, wherein said fluid passage is symmetrically located within said nozzle body.

* * * * *